US005797524A

United States Patent [19]

Lentz

[11] Patent Number: 5,797,524

[45] Date of Patent: Aug. 25, 1998

[54] SPIGOT ACTUATOR ASSEMBLY AND METHOD

[75] Inventor: Roger W. Lentz, Warminster, Pa.

[73] Assignee: Rapid Cartridge Dispensing Systems, Inc., Lionville, Pa.

[21] Appl. No.: 710,458

[22] Filed: Sep. 18, 1996

[51] Int. Cl.[6] ..... B67D 3/00

[52] U.S. Cl. ..... 222/505; 222/1; 222/105; 251/285

[58] Field of Search ..... 222/105, 505, 222/509, 1; 251/285, 339

[56] References Cited

U.S. PATENT DOCUMENTS

| | | | |
|---|---|---|---|
| 184,713 | 11/1876 | Karshner | 222/505 |
| 4,169,548 | 10/1979 | Bond | 251/339 X |
| 4,211,348 | 7/1980 | Scholle . | |
| 4,905,875 | 3/1990 | Straiton . | |
| 4,938,386 | 7/1990 | Roethel et al. . | |
| 5,402,919 | 4/1995 | Atkinson . | |

*Primary Examiner*—Gregory L. Huson
*Attorney, Agent, or Firm*—John F. A. Earley; John F. A. Earley, III; Harding, Earley, Follmer & Frailey

[57] ABSTRACT

A spigot actuator assembly for dispensing liquid from a spigot mounted on a projecting spout of a bag-in-box container for operating a dispensing lever on the spigot to move the dispensing lever from a horizontal closed position to an upwardly projecting open position for dispensing the liquid from the container, and for quickly replacing the container when desired. A method of using the spigot actuator assembly including snapping the spigot actuator assembly onto the spout, pushing down on a lever of the spigot actuating assembly for dispensing the liquid, releasing the actuator assembly to automatically close the spout, and snapping off the actuator assembly from the spout when it is desired to remove the container, and snapping a replacement container onto the actuator assembly.

10 Claims, 2 Drawing Sheets

BEST AVAILABLE COPY

SPIGOT ACTUATOR ASSEMBLY AND METHOD

CROSS-REFERENCE TO RELATED APPLICATIONS

This patent application is related to patent application Ser. No. 08/416,644, and now U.S. Pat. No. 5,673,817, filed Apr. 5, 1995 entitled ALL-PURPOSE DISPENSER which shows a dispenser adapted to receive a bag-in-box container and spout.

BACKGROUND OF THE INVENTION

Technical Field

This invention relates to the dispensing of liquids from bag-in-box disposable containers, and more particularly concerns an actuator assembly for dispensing liquid from a spigot mounted an the spout of a bag of a bag-in-box container.

A very successful spigot for bag-in-box containers is disclosed in U.S. pat. No. 4,211,348 that issued on Jul. 8, 1980, to William R. Scholle, which is incorporated herein by reference.

However, in the Scholle spigot the rate of flow of liquid from the container cannot be easily controlled by the finger which pushes up on the dispensing lever. Accordingly, a customer may, for example, get more or less than he wants of the cream that he is pouring into his coffee.

Also, sanitation may be a problem. When the bag-in-box container is used in the home, it is put into a home refrigerator accessible only to the family who know the desirability of having clean hands when using the bag-in-box spigot to pour, for example, a glass of milk. However, in commercial establishments such as fast food restaurants, a customer may not have had an opportunity to wash his hands before he pushes his finger upwardly on the dispensing lever of the bag-in-box spigot.

Further, no matter how many signs are placed on the machine containing bag-in-box container, customers push down on the dispensing lever of the Scholle spigot instead of pushing up to open the spigot. In this respect, the spigot is not quite user friendly.

SUMMARY OF THE INVENTION

The present invention is user friendly and provides a spigot actuator having a handle that you push down on to push up on the dispensing lever of the spigot and open the spigot. Also, the spigot actuator protects the dispensing lever from access by the hands of the customers and thereby avoids contamination by dirty hands so that it solves the sanitation problem.

The spigot actuator of the present invention is quickly attached to the spigot, quickly adjusted to the desired rate of flow of the liquid, and quickly removed when it is desired to change the container.

DETAILED DESCRIPTION OF THE DRAWINGS

Figure 1:
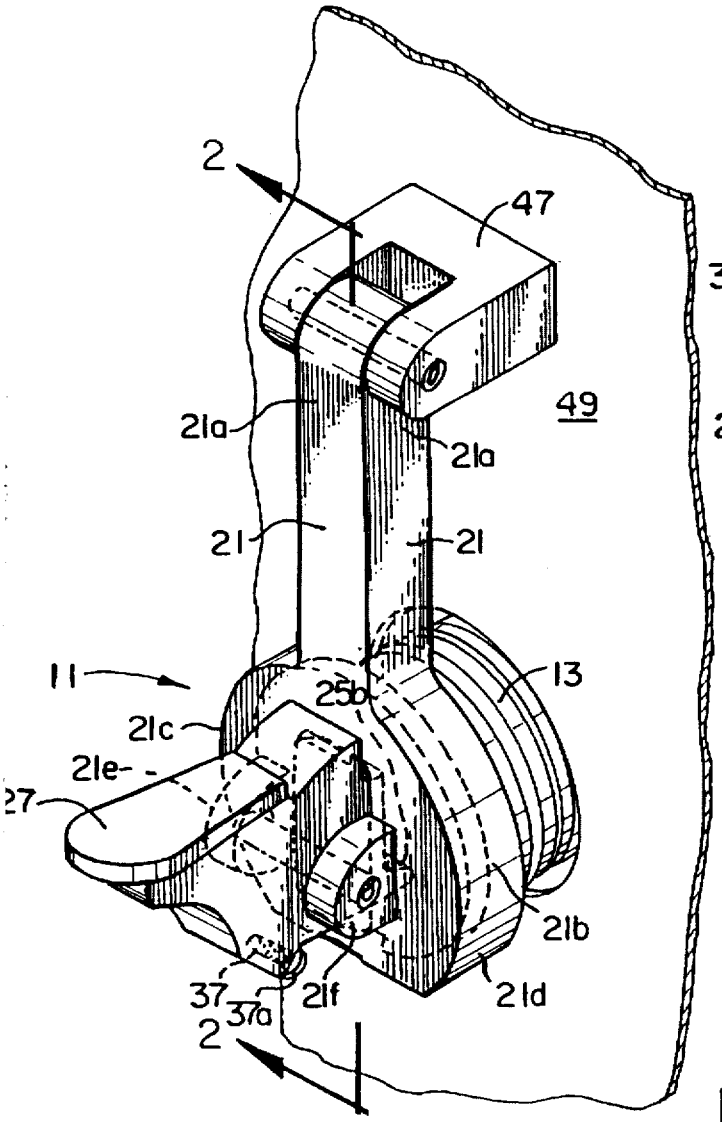
FIG. 1 is view in perspective of the spigot actuator constructed in accordance with this invention.
Figure 3:
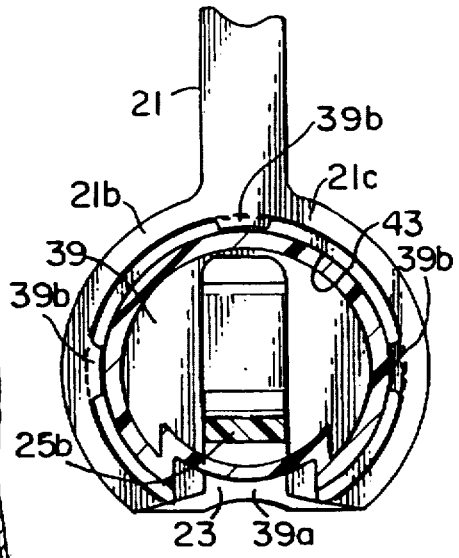
FIG. 3 is a view in section taken as indicated by the lines and arrows 3—3 in FIG. 2.
Figure 2:
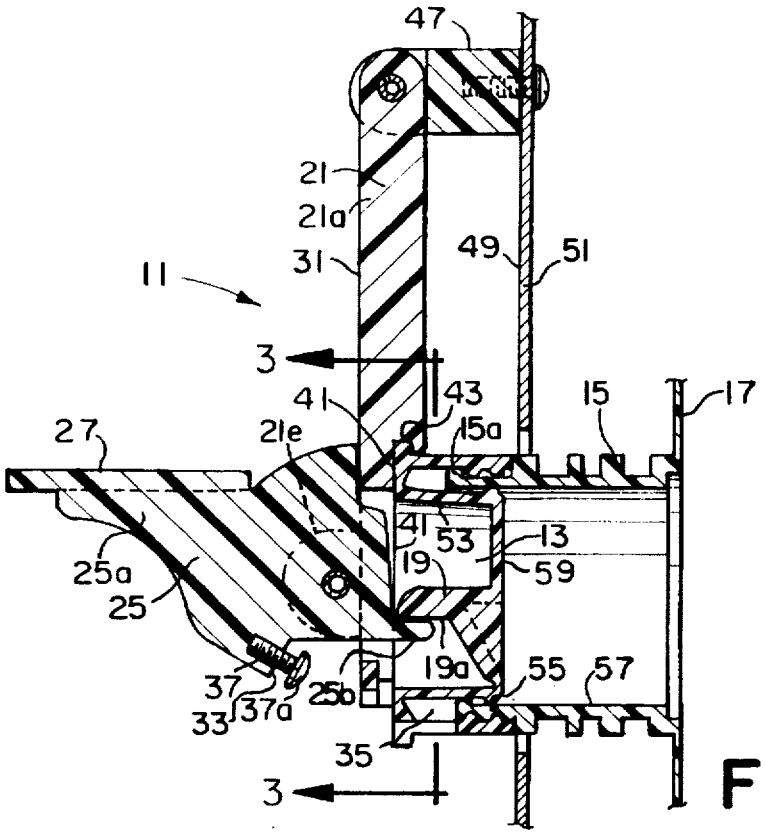
FIG. 2 is a view in section taken as indicated by the lines and arrows 2—2 in FIG. 1 and shows the actuator and spigot in closed position.
Figure 2A:
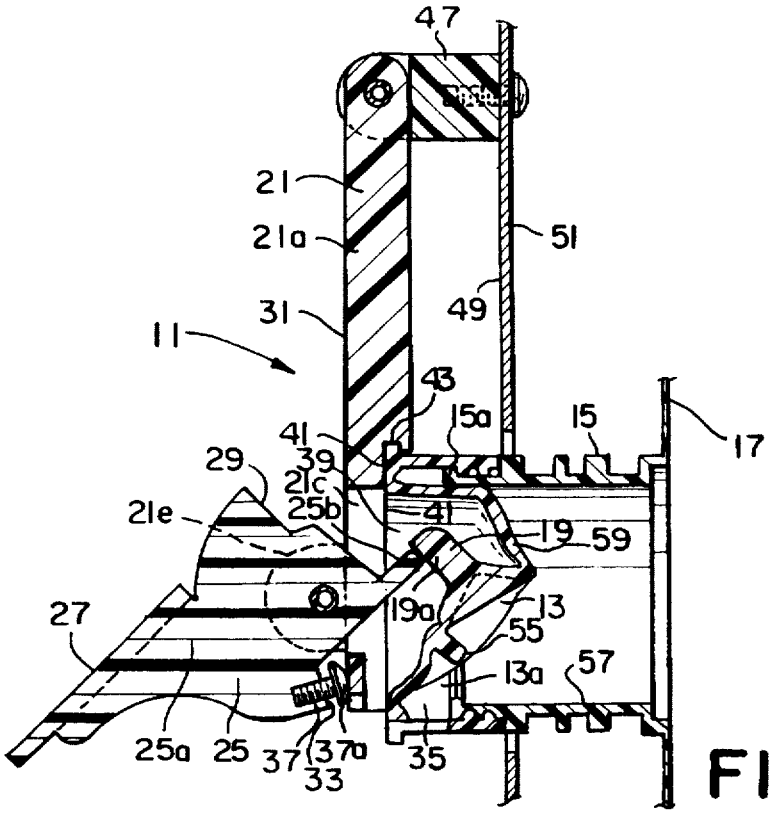
FIG. 2A is a view in section taken as indicated by the arrows 2—2 in FIG. 1 and shows the spigot actuator and spigot in open position.

Turning now the drawings, there is shown a spigot actuator assembly 11 for dispensing liquid from a spigot 13 mounted on a projecting spout 15 of a bag-in-box plastic bag container 17 for actuating a dispensing lever 19 on the spigot 13 to move the dispensing lever 19 from a horizontal closed position shown in FIG. 2 to an upwardly projecting open position shown in FIG. 2A. The dispensing lever 19 has a lower surface **19*a* adapted for engagement by a finger of a user for moving the dispensing lever 19 upwardly to open the spigot 13 when the spigot actuator assembly 1** is not provided.

Spigot actuating assembly 11 comprises a holder member 21 having a top portion **21*a* and a forked bottom portion 21*b* with 2 legs 21*c*, 21*d* being spaced apart and defining a slot 23** between them.

An actuating arm member 25 has a body portion **25*a* pivotally connected to ears 21*e*, 21*f* of the holder member 21 and positioned between the legs 21*c*, 21*d* in the slot 23**.

An actuating finger **25*b* projects axially inwardly from the body portion 25*a* of the actuating arm member 25 and is adapted to contact and open the dispensing lever 19 of the spigot 13**.

A handle 27 projects axially outwardly from the body portion **25*a*, and there is a stop shoulder 29 at the top of the body portion 25*a* for contacting the axially outward face 31 of the holder member 21 for limiting movement of the actuating arm member 25 and the actuating finger 25*b***.

A stop shoulder 33 at the bottom of the body portion **25*a* is also provided for limiting movement of the actuating body portion 25*a* and the actuating finger 25*b***.

Adjusting means are provided on the face of bottom stop shoulder 33 for adjusting the movement of the actuating body portion **25*a* and the actuating finger 25*b* to adjust and vary the size of the opening 35 in spigot 13 and vary the volume and rate of flow of the liquid through the spout 15 and spigot 13**.

The adjustable means comprises a screw 37 mounted on the bottom stop shoulder 33 and adapted to contact the front face 31 of holder member 21. Screw 37 is adapted to be rotated to vary the distance between the head **37*a* of screw 37 and the stop shoulder 33**.

A rear chamber 39 is formed by the axial back face 41 and circular wall 43 of the fork bottom portion **21*b* for receiving the spigot 13. The chamber 39 has an open bottom 39*a* for dispensing liquids, and is provided with means for holding the spigot 13 in the chamber 39. The means for holding the spigot 13 in the rear chamber 39 comprises tabs 39*b* which extend radially inwardly from the axially inward edges of the circular wall 43 of the chamber 39**.

The spigot actuator assembly 11 includes a bracket 47 pivotally connected to the top portion **21*a* of the holder member 21 and adapted to be mounted on the face 49 of a front door panel 51 of a cartridge which holds the container 17**.

The spigot and actuator assembly 11 combination for dispensing liquid from the spigot 13 which is mounted on the spout 15 of a plastic bag container 17 includes the spigot 13 which is an integral elastomeric member of generally cup shape having a peripheral wall 53 adapted to fit within the spout 15 axially inwardly of the lip **15*a* of the spout 15. The peripheral wall 53 has at least one sealing bead 55 on its outer surface for sealing engagement with the inner surface 57 of spigot 13 axially inwardly from the lip 15***a* of the spout. A transverse wall 59 at the inner end of the spigot peripheral wall 53 provides for closing the spigot 13 and the spout 15.

Manipulative means, such as dispensing lever 19, extend from the spigot transverse wall 59 for flexing the transverse wall 59 and a portion of the peripheral wall 53 and sealing bead 55 to move the portion of the peripheral wall 53 and sealing bead 55 radially inwardly away from the inner wall of spout 15 to form an opening 13*a* in the spout 13 to permit the dispensing of the contents of the container 17 while other portions of the seal 55 remain against the inner wall of spout 15.

In operation, the method of using the actuator assembly 11 for dispensing liquid from the spout 15 of container 17 comprises providing a spigot 13 which is an integral elastomeric member of generally cup shape having a peripheral wall 53 adapted to fit within the spout 15 axially inwardly of the lip 15*a* of the spout 15, with the spout peripheral wall 53 having at least one sealing bead 55 on the outer surface thereof for sealing engagement with the inner surface 57 of the spigot 13 axially inwardly from the lip 15*a* of the spout 15, a transverse wall 59 at the inner end of the spigot peripheral wall 53 for closing the spigot 13 and the spout 15, and manipulative means extending from the spigot transverse wall 57 for flexing the transverse wall 59 and a portion of the peripheral wall 53 and sealing bead 55 to move the portion of the peripheral wall 53 and sealing bead 55 radially inwardly away from the spout 15 to form an opening 35 in the spigot 13 to permit dispensing of the contents of the container 17 while other portions of the sealing bead 55 remain against said spout 15.

Also providing a holder member 21 having a top portion 21*a* and a forked bottom portion 21*b* with two legs 21*c*, 21*d* spaced apart and defining a slot 23 between them, an actuating arm member 25 having a body portion 25*a* pivotally connected to the holder member 21 and positioned between the legs 21*c*, 21*d* of the slot 23, an actuating finger 25*b* projecting axially inwardly from the body portion 25*a* of the arm member 25 and adapted to contact and to open the dispensing lever 19 of the spigot 13, a handle 27 projecting axially outwardly from the body portion 25*a* of the holder member 21, a stop shoulder 29 at the top of the body portion 25*a* for contacting the axially outward face 31 of the holder member 21 for limiting movement of the actuating arm member 25 and the actuating finger 25*b*, a stop shoulder 33 at the bottom of the body portion 25*a* for limiting movement of the actuating body portion 25*a* and the actuating finger 25*b*, and adjustable means on the bottom stop shoulder 33 for adjusting the movement of the actuating arm member 25 and the actuating finger 25*b* to adjust and vary the size of the opening 35 of the spigot 13 and vary the volume of flow of liquid through the spout 15 and spigot 13, the adjustable means comprising a screw 37 mounted on the bottom stop shoulder 33 and adapted to contact the outward front face 31 of the holder member 21 and adapted to be rotated to vary the distance the head 37*a* of the screw 37 is from the stop shoulder 33, a rear chamber 39 formed by the axial back face 41 and the circular wall 43 of the forked bottom portion for receiving the spigot 13, the rear chamber 39 having an open bottom 39*a* for dispensing liquids, means for holding the spigot 13 in the chamber 39, spigot holding means in the chamber 39 comprising tabs 39*b* which radially extend inwardly from the axially inward edges of the wall 43 of the chamber 39, and a bracket 47 pivotally connected to the top portion 21*a* of the holder member 21 and adapted to be mounted on the face 49 of a front door panel 51 of a cartridge which holds the container 17.

Also, attaching the bracket 47 to the front face 49 of a panel 51 of a cartridge which holds the container 17, pushing up on the handle 27 to position the actuating finger 25*b* below the dispensing lever 19 of the spigot 13, snapping the holder member 21 onto the spigot 13 by pushing the rear chamber 39 onto the spigot 13 by flexing the rubbery outer wall of the spigot 13, adjusting the adjustment screw 37 to set the desired flow of contents from the container 17, pushing down on the handle 27 to push the actuating finger 25*b* up on the dispensing lever 19 and open the spigot 13 and cause the liquid in the container 17 to flow out of the spigot 13, releasing the handle 27 to cause the dispensing lever 19 to automatically return to closed position, removing the spigot 13 from said holder member 21 when the container 17 is empty or when the container 17 needs to be changed for another container by snapping the rear chamber 39 away from the spigot 13, leaving the holder member 21 attached to the front door panel 51 of the cartridge holding the container 17 so that the holder member 21 does not get lost, replacing the container 17 with another container, and snapping the chamber 39 onto the spigot of the other container.

I claim:

1. An actuator assembly for dispensing liquid from a spigot mounted on a projecting spout of a container for actuating a dispensing lever on the spigot to move the dispensing lever from a horizontal closed position to an upwardly projecting open position, said dispensing lever having a lower surface adapted for engagement by a finger of a user for moving said dispensing lever upwardly to open the spigot, comprising a holder member having a top portion and a forked bottom portion with two legs spaced apart and defining a slot between them, an actuating arm member having a body portion pivotally connected to the holder member and positioned between said legs in said slot, an actuating finger projecting axially inwardly from said body portion of the arm member and adapted to contact and open the dispensing lever of the spigot, a handle projecting axially outwardly from said body portion of the holder member, a stop shoulder at the top of the body portion for contacting the axially outward face of the holder member for limiting movement of the actuating arm member and the actuating finger, a stop shoulder at the bottom of the body portion for limiting movements of the actuating body portion and the actuating finger, and adjustable means on the bottom stop shoulder for adjusting the movement of the actuating body portion and the actuating finger to adjust and vary the size of the opening in the spigot and vary the volume of flow of liquid through the spout and spigot.

2. The actuator assembly of claim 1, said adjustable means comprising a screw mounted on the bottom stop shoulder and adapted to contact the front face of the holder and adapted to be rotated to vary the distance of the head of the screw from the stop shoulder.

3. The actuator assembly of claim 1, including a rear chamber formed by an axial back face and a circular wall of said forked bottom portion for receiving the spigot, said chamber having an open bottom for dispensing liquids, and means for holding the spigot in the chamber.

4. The actuator assembly of claim 3, said holding means comprising tabs which radially extend inwardly from the axially inward edges of the wall of the chamber.

5. The actuator assembly of claim 1, including a bracket pivotally connected to the top portion of the holder member and adapted to be mounted on the face of a front door panel of a cartridge which holds the container.

6. An actuator assembly for dispensing liquid from a spigot mounted on a projecting spout of a container for actuating a dispensing lever on the spigot to move the dispensing lever from a horizontal closed position to an upwardly projecting open position, said dispensing lever having a lower surface adapted for engagement by a finger of a user for moving said dispensing lever upwardly to open the spigot, comprising a holder member having a top portion and a forked bottom portion with two legs spaced apart and defining a slot between them, an actuating arm member having a body portion pivotally connected to the holder member and positioned between said legs in said slot, an actuating finger projecting axially inwardly from said body portion of the arm member and adapted to contact and open the dispensing lever of the spigot, a handle projecting axially outwardly from said body portion of the holder member, a stop shoulder at the top of the body portion for contacting the axially outward face of the holder member for limiting movement of the actuating arm member and the actuating finger, a stop shoulder at the bottom of the body portion for limiting movement of the actuating body portion and the actuating arm, and adjustable means on the bottom stop shoulder for adjusting the movement of the actuating body portion and the actuating finger to adjust and vary the size of the opening in the spigot and vary the volume of flow of liquid through the spout and spigot, said adjustable means comprising a screw mounted on the bottom stop shoulder and adapted to contact the front face of the holder and adapted to be rotated to vary the distance of the head of the screw from the stop shoulder.

a rear chamber formed by an axial back face and a circular wall of said forked bottom portion for receiving the spigot, said chamber having an open bottom for dispensing liquids, means for holding the spigot in the chamber, said holding means comprising tabs which radially extend inwardly from the axially inward edges of the wall of the chamber, and a bracket pivotally connected to the top portion of the holder member and adapted to be mounted on the face of a front door panel of a cartridge which holds the container.

7. A spigot and actuator assembly combination for dispensing liquid from a spigot mounted on a spout of a container, said spigot comprising an integral elastomeric member of generally cup shape having a peripheral wall complementary to and adapted to fit within the spout axially inwardly of the lip of the spout, said spigot peripheral wall having at least one sealing bead on the outer surface thereof for sealing engagement with the inner surface of the spout axially inwardly from the lip of the spout, a transverse wall at the inner end of said spigot peripheral wall for closing the spigot and the spout, manipulative means extending from said spigot transverse wall for flexing said transverse wall and a portion of said peripheral wall and sealing bead in a toggle effect to move said portion of said peripheral wall and sealing bead radially inwardly away from the spout to form an opening in the spigot to permit the dispensing of the contents of the container while other portions of said sealing bead remain against said spout, a holder member having a top portion and a forked bottom portion with two legs spaced apart and defining a slot between them, an actuating arm member having a body portion pivotally connected to the holder member and positioned between said legs in said slot, an actuating finger projecting axially inwardly from said body portion of the arm member and adapted to contact and open the dispensing lever of the spigot, a handle projecting axially outwardly from said body portion of the holder member, a stop shoulder at the top of the body portion for contacting the axially outward face of the holder member for limiting movement of the actuating arm member and the actuating finger, a stop shoulder at the bottom of the body portion for limiting movement of the actuating body portion and the actuating finger, and adjustable means on the bottom stop shoulder for adjusting the movement of the actuating body portion and the actuating finger to adjust and vary the size of the opening of the spigot and vary the volume of flow of liquid through the spout and spigot.

8. The combination of claim 7, said adjustable means comprising a screw mounted on the bottom stop shoulder and adapted to contact the front face of the holder and adapted to be rotated to vary the distance of the head of the screw from the stop shoulder, a rear chamber formed by an axial back face and a circular wall of said forked bottom portion for receiving the spigot, said rear chamber having an open bottom for dispensing liquids, means for holding the spigot in the chamber, said spigot holding means in the chamber comprising tabs which radially extend inwardly from the axially inward edges of the wall of the chamber, and a bracket pivotally connected to the top portion of the holder member and adapted to be mounted on the face of a front door panel of a cartridge which holds the container.

9. A method of using a spigot actuating assembly for dispensing liquid from a spigot mounted on a spout of a container, said spigot comprising an integral elastomeric member of generally cup shape having a peripheral wall adapted to fit within the spout axially inwardly of the lip of the spout, said spigot peripheral wall having at least one sealing bead on the outer surface thereof for sealing engagement with the inner surface of the spout axially inwardly from the lip of the spout, a transverse wall at the inner end of said spigot peripheral wall for closing the spigot and the spout, manipulative means extending from said spigot transverse wall for flexing said transverse wall and a portion of said peripheral wall and sealing bead to move said portion of said peripheral wall and sealing bead radially inwardly away from the spout to form an opening in the spigot to permit the dispensing of the contents of the container while other portions of said sealing bead remain against said spout, a holder member having a top portion and a forked bottom portion with two legs spaced apart and defining a slot between them, an actuating arm member having a body portion pivotally connected to the holder member and positioned between said legs in said slot, an actuating finger projecting axially inwardly from said body portion of the arm member and adapted to contact and to open the dispensing lever of the spigot, a handle projecting axially outwardly from said body portion of the holder member, a stop shoulder at the top of the body portion for contacting the axially outward face of the holder member for limiting movement of the actuating arm member and the actuating finger, a stop shoulder at the bottom of the body portion for limiting movement of the actuating body portion and the actuating finger, and adjustable means on the bottom stop shoulder for adjusting the movement of the actuating body portion and the actuating arm to adjust and vary the size of the opening of the spigot and vary the volume of flow of liquid through the spout and spigot, said adjustable means comprising a screw mounted on the bottom stop shoulder and adapted to contact the front face of the holder and adapted to be rotated to vary the distance the head of the screw is from the stop shoulder, a rear chamber formed by an axial back face and a circular wall of said forked bottom portion for receiving the spigot, said rear chamber having an open bottom for dispensing liquids, means for holding the spigot in the chamber, said spigot holding means in the chamber comprising tabs which radially extend inwardly from the axially inward edges of the wall of the chamber, and a bracket pivotally connected to the top portion of the holder member and adapted to be mounted on the face of a front door panel of a cartridge which holds the container, pushing up on the handle to position the actuating finger below the dispensing lever, snapping the holder onto the spigot by pushing the rear chamber onto the spigot by flexing the outer wall of the spigot, adjusting the adjustment screw to set the desired flow from the contents of the container, pushing down on the handle to push the actuating finger up on the dispensing lever and open the spigot and cause the liquid in the container to flow out of the spigot, releasing the handle to cause the dispensing lever to automatically return to closed position, removing the spigot from said holder when the container is empty, or when the container needs to be changed for another container, by snapping the rear chamber away from the spigot, leaving the holder assembly attached to the front door panel of the cartridge holding the container so that the holder does not get lost, replacing the container with another container, and snapping the chamber onto the spigot of the other container.

10. A method of using a spigot actuating assembly for dispensing liquid from a spigot mounted on a spout of a container, said spigot comprising an integral elastomeric member of generally cup shape having a peripheral wall adapted to fit within the spout axially inwardly of the lip of the spout, said spigot peripheral wall having at least one sealing bead on the outer surface thereof for sealing engagement with the inner surface of the spout axially inwardly from the lip of the spout, a transverse wall at the inner end of said spigot peripheral wall for closing the spigot and the spout, manipulative means extending from said spigot transverse wall for flexing said transverse wall and a portion of said peripheral wall and sealing bead to move said portion of said peripheral wall and sealing bead radially inwardly away from the spout to form an opening in the spigot to permit the dispensing of the contents of the container while other portions of said sealing bead remain against said spout, a holder member having a top portion and a forked bottom portion with two legs spaced apart and defining a slot between them, an actuating arm member having a body portion pivotally connected to the holder member and positioned between said legs in said slot, an actuating finger projecting axially inwardly from said body portion of the arm member and adapted to contact and to open the dispensing lever of the spigot, a handle projecting axially outwardly from said body portion of the holder member, a stop shoulder at the top of the body portion for contacting the axially outward face of the holder member for limiting movement of the actuating arm member and the actuating finger, a stop shoulder at the bottom of the body portion for limiting movement of the actuating body portion and the actuating finger, and adjustable means on the bottom stop shoulder for adjusting the movement of the actuating body portion and the actuating arm to adjust and vary the size of the opening of the spigot and vary the volume of flow of liquid through the spout and spigot, said adjustable means comprising a screw mounted on the bottom stop shoulder and adapted to contact the front face of the holder and adapted to be rotated to vary the distance the head of the screw is from the stop shoulder, a rear chamber formed by an axial back face and a circular wall of said forked bottom portion for receiving the spigot, said rear chamber having an open bottom for dispensing liquids and, means for holding the spigot in the chamber, said spigot holding means in the chamber comprising tabs which radially extend inwardly from the axially inward edges of the wall of the chamber, pushing up on the handle to position the actuating finger below the dispensing lever, snapping the holder onto the spigot by pushing the rear chamber onto the spigot by flexing the outer wall of the spigot, adjusting the adjustment screw to set the desired flow from the contents of the container, pushing down on the handle to push the actuating finger up on the dispensing lever and open the spigot and cause the liquid in the container to flow out of the spigot, releasing the handle to cause the dispensing lever to automatically return to closed position, removing the spigot from said holder when the container is empty, or when the container needs to be changed for another container, by snapping the rear chamber away from the spigot, replacing the container with another container, and snapping the chamber onto the spigot of the other container.

* * * * *